US005174385A

United States Patent [19]

Shinbo et al.

[11] Patent Number: 5,174,385

[45] Date of Patent: Dec. 29, 1992

[54] BLADE CONTROL SYSTEM FOR BULLDOZER

[75] Inventors: Tetsuya Shinbo; Toyoichi Ono, both of Hiratsuka, Japan

[73] Assignee: Kabushiki Kaisha Komatsu Seisakusho, Japan

[21] Appl. No.: 700,171

[22] PCT Filed: Sep. 14, 1989

[86] PCT No.: PCT/JP89/00943

§ 371 Date: May 7, 1991

§ 102(e) Date: May 7, 1991

[87] PCT Pub. No.: WO91/04378

PCT Pub. Date: Apr. 4, 1991

[51] Int. Cl.[5] ..... E02F 3/76

[52] U.S. Cl. ..... 172/4.5; 364/424.07; 37/DIG. 20

[58] Field of Search ..... 172/2, 4.5; 37/DIG. 1, 37/DIG. 20; 364/424.07; 104/7.1

[56] References Cited

U.S. PATENT DOCUMENTS

| | | | |
|---|---|---|---|
| 3,887,012 | 6/1975 | Scholl et al. | 172/4.5 |
| 3,953,145 | 4/1976 | Teach | 172/4.5 X |
| 4,162,708 | 7/1979 | Johnson | 172/4.5 |
| 4,244,123 | 1/1981 | Lazure et al. | 172/4.5 X |
| 4,402,368 | 9/1983 | Moberly | 172/4.5 |
| 4,482,960 | 11/1984 | Pryor | 172/4.5 X |
| 4,895,440 | 1/1990 | Cain et al. | 172/4.5 X |
| 4,912,643 | 3/1990 | Beirxe | 172/4.5 X |
| 5,000,564 | 3/1991 | Ake | 172/4.5 X |
| 5,022,763 | 6/1991 | Vaugnat | 172/4.5 X |

FOREIGN PATENT DOCUMENTS

| | | |
|---|---|---|
| 52-53363 | 12/1977 | Japan . |
| 55-105036 | 8/1980 | Japan . |
| 59-21836 | 2/1984 | Japan . |

*Primary Examiner*—Randolph A. Reese
*Assistant Examiner*—Jeffrey L. Thompson
*Attorney, Agent, or Firm*—Ronald P. Kananen

[57] ABSTRACT

A blade control system for a bulldozer enables the bulldozer to effectively perform a ground leveling work or a grading work with high accuracy in a minimum amount of time. The system compensates for pitching of a tractor portion of the bulldozer, and for variations in the amount of earth to be moved by a blade of the bulldozer. The system comprises: a pair of photo receivers (2, 3) which are mounted on the tractor portion (1) along a longitudinal axis of the portion (1) while spaced apart from each other, each of which receivers (2, 3) detects an optical reference plane (6) produced by a photo projector (4) to issue a level signal; and a blade controller (13) which controls an hydraulic valve actuaor (14) for moving the blade (8) based on the level signals. The receivers (2, 3) can detect a three-dimensional position of the tractor portion (1), and the blade controler (13) controls the actuator (14) upon receipt of an output signal issued from a position-measuring controller (23) which receives the level signals issued from the receivers (2, 3) to calculate a progress of the work.

5 Claims, 9 Drawing Sheets

| x \ y | y1 | y2 | y3 | y4 | | yn |
|---|---|---|---|---|---|---|
| x1 | h11 | h12 | .. | .. | | h1n |
| x2 | h21 | h22 | .. | .. | | h2n |
| x3 | h31 | h32 | .. | .. | | h3n |
| | | | | | | |
| xn | hn1 | hn2 | .. | .. | | hnn |

BLADE CONTROL SYSTEM FOR BULLDOZER

FIELD OF THE INVENTION

The present invention relates to a blade control system for a bulldozer, and more particularly to blade control system of a bulldozer for performing ground leveling work or a grading work based on signals issued from a level detecting unit, such as a photo receiver, mounted on a bulldozer, the level detecting unit being adapted to detect an optical reference plane which is formed by an optical projector so as to be horizontal in a predetermined range of area or so as to be inclined at an arbitrary angle in the area.

In addition, the present invention relates to such blade control system for the bulldozer, in which system the level detecting unit, e.g., a photo receiver, has the facility for detecting a three-dimensional position of the bulldozer so as to make it possible that an operator of the bulldozer measures progress of the ground leveling work or of the grading work.

BACKGROUND OF THE INVENTION

In ground leveling work or grading work performed over a wide range of area, a bulldozer is generally used. In this case, the more the range of area increases, the more the leveling control in ground finishing work or in grading work is important. Consequently, heretofore, it is usual to perform the ground finishing work with reference to a reference plane which is measured each time the ground finishing work is performed after the bulldozer performs the primary ground leveling work (hereinafter referred to as the "first conventional method").

On the other hand, in recent years, a second conventional method has been also developed for performing the ground leveling work or the grading work based on a reference plane which is formed by scanning a work area or ground with a laser beam light issued from a rotary laser projector installed in the work area.

In the second conventional method, the rotary laser projector is rotatably driven to form a horizontal optical reference plane or an oblique optical reference plane inclined at an arbitrary angle. A photo receiver for receiving a laser beam light issued from the laser projector is mounted on a bulldozer, and serves as a ground-level detecting unit for detecting a level of the ground relative to the optical reference plane to issue a level signal to a control unit of the bulldozer, so that a position of a blade of the bulldozer is automatically controlled based on the level signal to perform ground leveling work or grading work in an appropriate manner.

However, the above first conventional method is tedious and time consuming, and is poor in finishing quality of the ground leveling work.

On the other hand, the second conventional method suffers from a problem in that, since the ground-level detecting unit is directly mounted on the blade of the bulldozer so as to control a position of a cutting edge of the blade serving as a level target in the ground leveling work during which a tractor (which is a main vehicle body portion of the bulldozer) pitches considerably, a level signal or value issued from such ground-level detecting unit extremely varies from that of the optical reference plane during the ground leveling work. In addition, in the second conventional method, the bulldozer is restricted in working speed when its work area includes large concave and convex ground portions. Further, in the second conventional method, when the laser beam light issued from the rotary laser projector is interrupted by the other construction machines such as dump trucks, there is a fear that the position of the blade is not appropriately controlled since the position of the blade is controlled based on the level signal having been received before such interruption.

In addition, heretofore, in the ground leveling work or the grading work performed over a wide area, since it is general for a construction manager to empirically divide the area and empirically decide the execution order of the work in the area, the work is not necessarily performed in an effective manner.

SUMMARY OF THE INVENTION

In view of the above circumstances, the present invention was made. Therefore, it is an object of the present invention to provide a blade control system for a bulldozer, which system enables an operator of the bulldozer to effectively perform ground leveling work or grading work with high accuracy, regardless of the presence of pitching motion of a tractor or main vehicle body portion of the bulldozer in the work.

It is another object of the present invention to provide a blade control system for a bulldozer, which system enables an operator of the bulldozer to perform a uniform smoothing control of the finished ground surface and of the graded ground layer with high accuracy in a minimum of time, regardless of the amount of the earth to be removed by the blade.

The above objects of the present invention are accomplished in accordance with a first aspect of the present invention as follows.

In a blade control system for a bulldozer comprising, in order to perform ground leveling work or grading work by automatically controlling a vertical position of a blade of a bulldozer during the work: a light projecting means for forming over a predetermined area a horizontal optical reference plane or an oblique optical reference plane inclined at an arbitrary angle, the light projecting means being installed in a place remote from the bulldozer; a light receiving means which is mounted on a tractor body portion of the bulldozer, and detects the optical reference place formed by the light projecting means to issue a level signal; and a control means which receives the level signal to control a hydraulic valve actuator based on the level signal, which hydraulic valve actuator moves the blade of the bulldozer; the improvement wherein, the light receiving means comprises at least a pair of photo receivers which are arranged along a longitudinal axis of the tractor body portion of the bulldozer while spaced apart from each other, and a blade controller which controls the hydraulic valve actuator based on output signals issued from the pair of the photo receivers.

Further, the above objects of the present invention are accomplished in accordance with a second aspect of the present invention, as follows:

The blade control system for the bulldozer as set forth in the first aspect of the present invention, wherein:

the light projecting means comprises a pair of photo projectors;

each of the photo receivers of the light receiving means has the facility for detecting a three-dimensional position of the tractor body portion of the bulldozer; and the blade controller of the light receiving means controls the hydraulic valve actuator based on an output signal issued from a position measuring controller, which position measuring controller receives the level signal issued from each of the photo receivers to obtain progress data of the work.

In addition, the above objects of the present invention are accomplished in accordance with a third aspect of the present invention, as follows:

The blade control system for the bulldozer as set forth in the first aspect of the present invention, wherein:

the blade control system further comprises a cylinder stroke sensor which detects a stroke of the hydraulic valve actuator to issue a stroke signal of the thus detected stroke, the stroke signal being fed back to the blade control system.

Still further, the above objects of the present invention are accomplished in accordance with a fourth aspect of the present invention, as follows:

The blade control system for the bulldozer as set forth in the second aspect of the present invention, wherein:

further mounted on the bulldozer in addition to the photo receivers are a wireless unit and an on-vehicle monitor; and further installed on the ground are a ground wireless unit and a ground monitor.

In the present invention having the above aspects, when a ground level detecting unit (e.g. photo receivers) detects an optical reference plane formed by the photo projectors to issue a level signal, the blade controller determines an angle at which a frame of the blade is inclined based on a value of the level signal so as to automatically change a stroke of a cylinder which moves the blade. Consequently, in the present invention, it is possible for an operator of the bulldozer to smoothly perform predetermined ground leveling work regardless of the presence of pitching of a tractor body portion of the bulldozer. In addition, since at least a pair of the photo receivers are mounted on the bulldozer so as to be spaced apart from each other along a longitudinal axis of the tractor body portion of the bulldozer, it is possible for the operator to control the bulldozer with high accuracy in the work.

Further, in the present invention, since the ground level detecting unit (e.g. photo receivers) having the facility for detecting a three-dimensional position of the tractor body portion of the bulldozer is mounted on the tractor body portion so that the photo receivers are spaced apart from each other along the longitudinal axis of the tractor body portion of the bulldozer to make it possible to automatically control the progress of the work in a predetermined manner, the bulldozer with the blade control system of the present invention is advantageous in that, when the ground leveling work or the grading work is performed over a wide area, the blade control system of the present invention enables an operator of the bulldozer to perform a uniform smoothing control of the finished ground surface and of the graded ground layer with high accuracy in a minimum of time, regardless of the amount of the earth to be removed by the blade.

The above objects, additional objects, additional embodiments, and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, two preferred embodiments of a blade control system for a bulldozer of the present invention will be described in detail with reference to the accompanying drawings.

Figure 2:
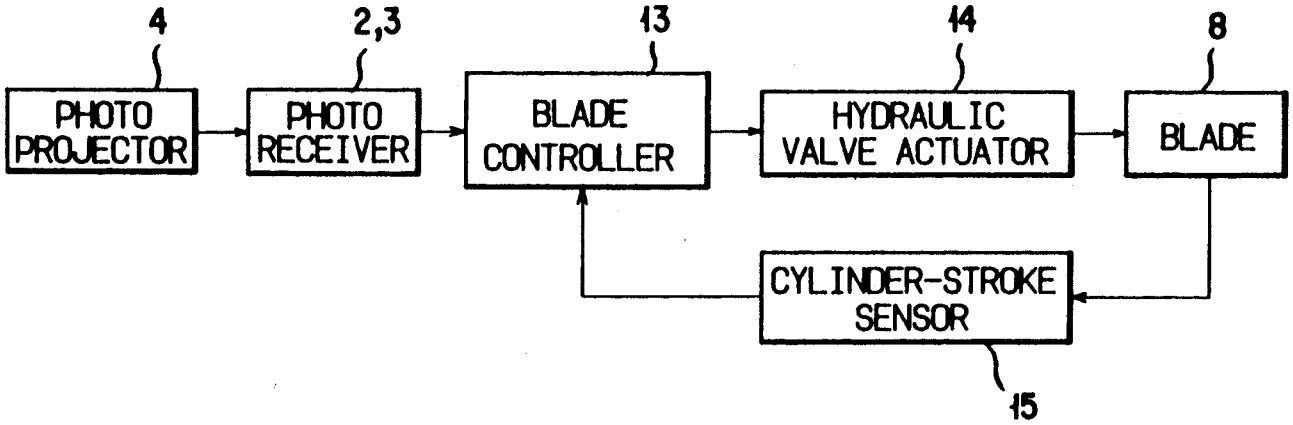
FIG. 2 is a block diagram of the blade control system of the present invention shown in FIG. 1.
Figure 3:
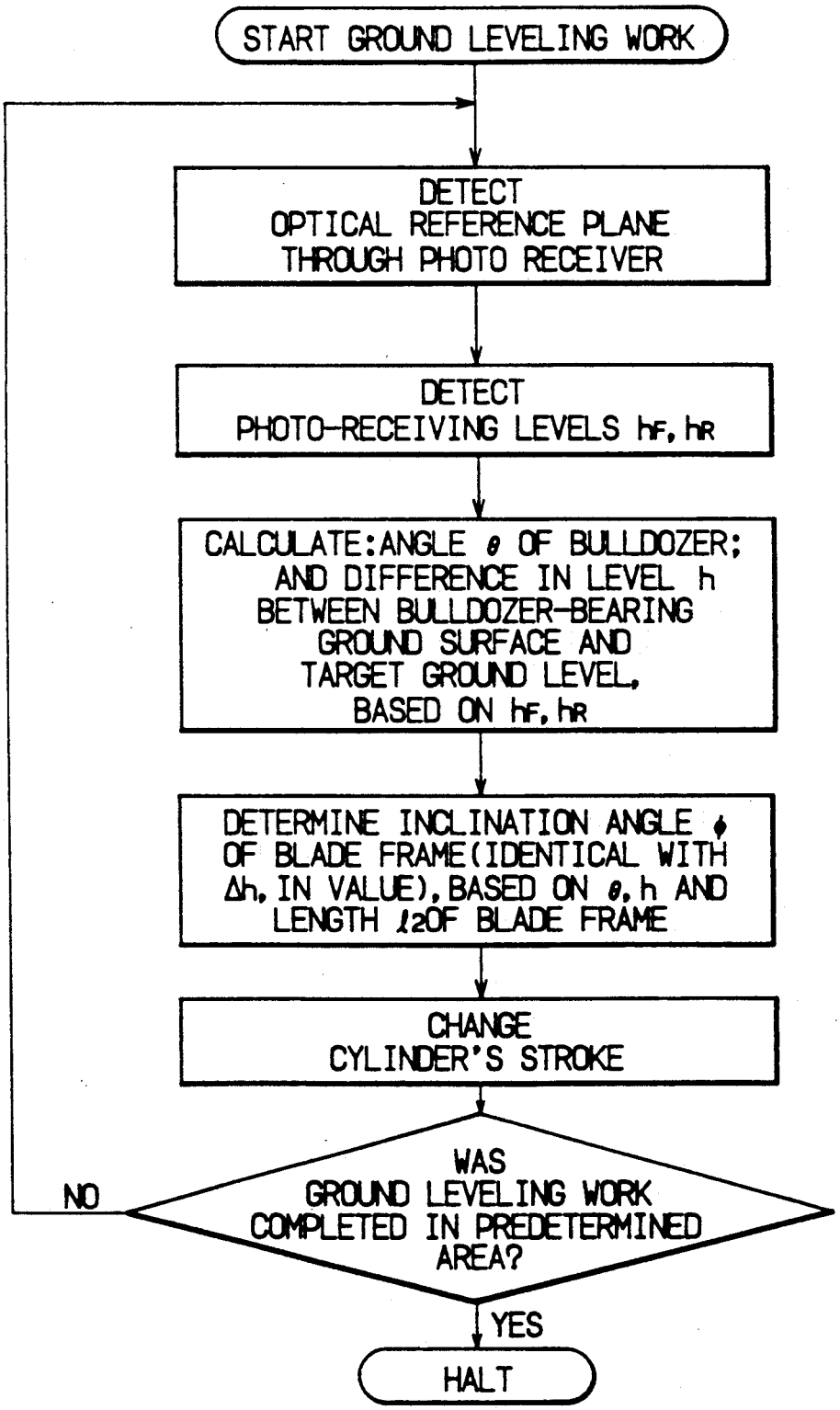
FIG. 3 is a flowchart of a process of controlling the blade of the bulldozer performed by the first embodiment of the present invention shown in FIG. 1.

First, with reference to FIGS. 1 to 3, a first embodiment of the present invention will be described.

Figure 1:
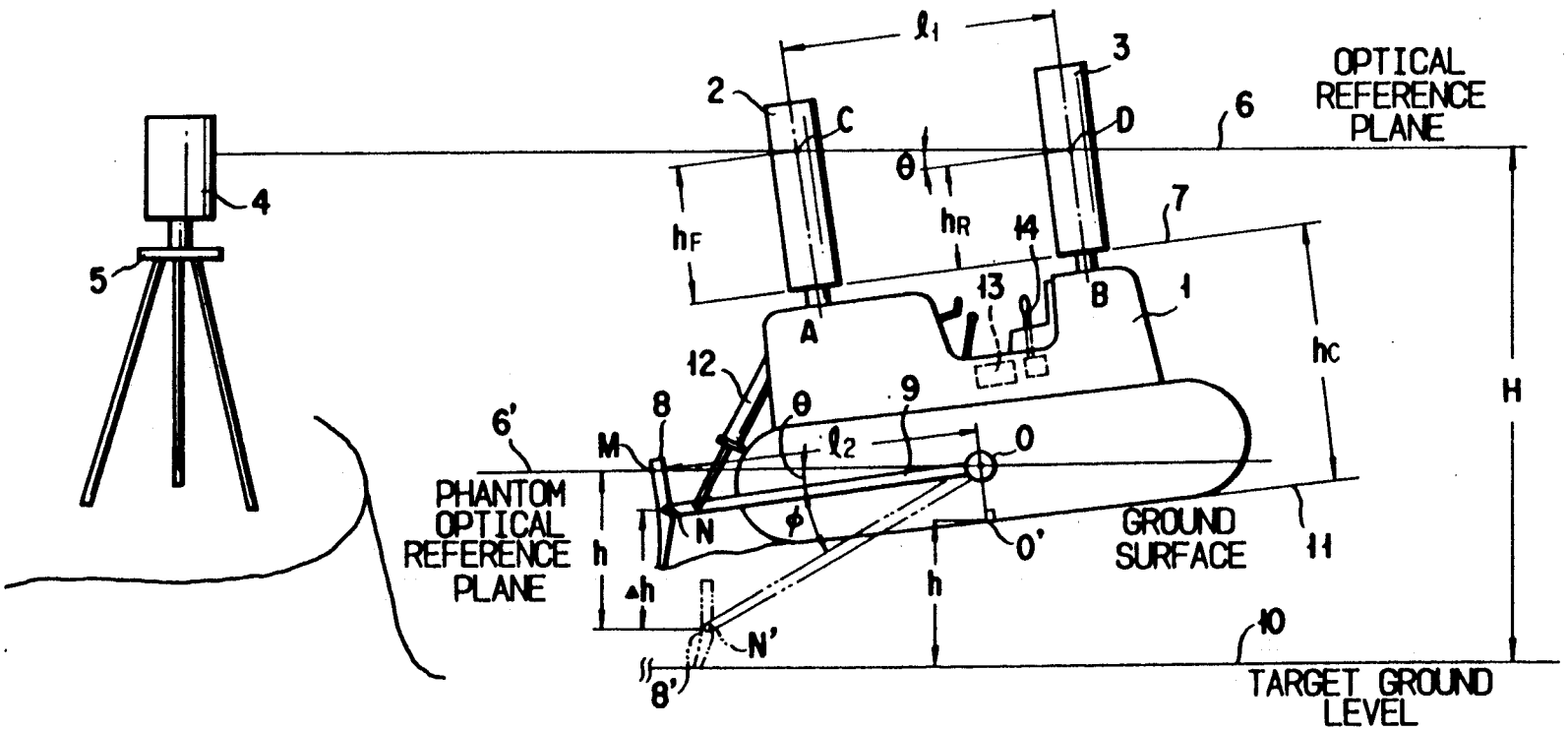
FIG. 1 is an overall schematic side view of a first embodiment of the blade control system of the present invention, illustrating the entire construction of the embodiment.

Now, as shown in FIG. 1, in the first embodiment of the blade control system for the bulldozer, a pair of light receiving means or photo receivers 2 and 3, each of which detects a laser beam light to determine a position of the bulldozer, are mounted on a front portion A and a rear portion B of a tractor body portion 1 of the bulldozer, respectively. On the other hand, a light projecting means or photo projector 4 is mounted on a stand 5 disposed in a place remote from the bulldozer. The photo projector 4 is of a rotary type adapted to issue a laser beam light in any desired direction, and may from a horizontal optical reference plane 6 over a predetermined area in which ground leveling work or grading work is performed. In addition, in case that the ground leveling work or the grading work must be performed parallel to an oblique ground surface in the area, the photo projector 4 may issue a laser beam light to form an oblique optical reference plane inclined at the same angle as that of the oblique ground surface. Now, the ground leveling work performed with reference to the horizontal optical reference plane 6 formed by the photo projector 4 will be described.

In operation, the laser beam light issued from the photo projector 4 and forming the optical reference plane 6 is detected by the pair of the photo receivers 2, 3 mounted on the tractor body portion 1 of the bulldozer. In the first embodiment of the present invention, as shown in FIG. 1: a tractor reference plane 7 is formed between the photo receivers 2, 3 on the tractor body portion 1 of the bulldozer, wherein the tractor reference plane 7 is parallel to a longitudinal axis of the tractor body portion 1 of the bulldozer; the reference character $h_F$ denotes a distance between the tractor reference plane 7 and a light receiving point C of the photo receiver 2, at which point C the laser beam light issued from the photo projector 4 is received by the photo receiver 2; the reference character $h_R$ denotes a distance between the tractor reference plane 7 and a light receiving point D of the photo receiver 3, at which point D the laser beam light issued from the photo projector 4 is received by the photo receiver 3; and the reference character $l_1$ denotes a distance between the photo receivers 2 and 3. In this case, therefore, the angle of the tractor reference plane 7 of the tractor body portion 1 of the bulldozer from the optical reference plane 6 is denoted by the reference character $\theta$ which is represented by the following equation:

$$\theta = \tan^{-1}((h_F - h_R)/(l_1)) \quad (1)$$

Now, the ground leveling work will be described in detail. In FIG. 1: the reference character $l_2$ denotes a length of a frame 9 through which a blade 8 is connected with a central portion or point 0 of the tractor body portion 1 of the bulldozer; the reference numeral 10 denotes a horizontal target ground level to be accomplished by the blade 8; the reference numeral 11 denotes a tractor-bearing ground surface bearing the tractor body portion 1 of the bulldozer; the reference character 0' denotes a point at which the tractor-bearing ground surface 11 intersects with a line passing through the central point 0 of the tractor body portion 1 of the bulldozer, which line is perpendicular to the ground surface 11; the reference character N denotes a central point of the blade 8, at which central point N the blade 8 is connected with the frame 9; the reference character h denotes a distance between the point 0' and the horizontal target ground level 10 which is parallel to the optical reference plane 6; the reference numeral 6' denotes a phantom optical reference plane passing through the central point 0 of the tractor body portion 1 of the bulldozer, the phantom optical reference plane 6' being parallel to the optical reference plane 6; and the reference character M denotes a point at which the phantom optical reference plane 6' intersects with the blade 8 in a condition in which the frame 9 is parallel to the tractor-bearing ground surface 11.

In the ground leveling work, as shown in FIG. 1, the blade 8 of the bulldozer is lowered by the cylinder 12 to remove earth to such an extent that the blade 8 reaches its phantom position 8' adjacent to the target ground level 10, in which phantom position 8' the blade 8 is connected with the frame 9 at an intersection point N'. Consequently, a vertical distance h between the point 0' and the target ground level 10 is identical with a vertical distance between the point M of the blade 8 and a horizontal plane passing through the point N' of the phantom position 8' of the blade 8. This vertical distance h may be calculated in a proper manner based on: the above data $h_F$, $h_R$, $\theta$; a distance H between the optical reference plane 6 and the target ground level 10; and a distance $h_c$ between the tractor reference plane 7 and the tractor-bearing ground surface 11.

In the ground leveling work, as shown in FIG. 1, the angle $\theta$ at which the tractor body portion 1 of the bulldozer is inclined in pitching motion thereof relative to the horizontal optical reference plane 6 may be represented by the following equation, because the angle $\theta$ is formed between the phantom optical reference plane 6' and a longitudinal axis of the frame 9:

$$\Delta h = h - l_2 \times \sin\theta \quad (2)$$

wherein: $\Delta h$ denotes a vertical distance between the point N of the blade 8 and a horizontal plane passing through the point N' of the phantom position 8' of the blade 8.

Consequently, in the ground leveling work, the cylinder 12 of the bulldozer is operated to tilt the frame 9 by an angle $\phi$, so that the blade 8 is lowered by a distance $\Delta h$ to make it possible to lower the cutting edge of the blade 8 to the target ground level 10.

Now, with reference to FIG. 2, the above operation of the cylinder 12 of the bulldozer will be described.

After the pair of the photo receivers 2, 3 receive the laser beam light issued from the photo projector 4 to issue output signals to a blade controller 13, then, the controller 13 performs necessary calculations based on the output signals by the use of the above equations (1), (2) to issue an instruction signal (which has a value of, for example $\Delta h$) to a hydraulic valve actuator 14 which in turn operates the cylinder 12 of the bulldozer to tilt the frame 9 by the angle $\phi$ so that the blade 8 is lowered by the distance $\Delta h$ to reach the phantom position 8' thereof. In this case, a cylinder-stroke sensor 15, which is incorporated in the cylinder 12, measures an amount of stroke of the cylinder 12 and issues a stroke signal fed back to the blade controller 13 to enable the blade 8 to reach its phantom position 8' adjacent to the target ground level 10. An example of the above process performed by the blade control system of the present invention is shown in a flowchart seen in FIG. 3. In the ground leveling work, the above process is repeated by the blade control system for the bulldozer of the present invention over the area to be leveled.

Now, a second embodiment of the blade control system of the present invention will be described with reference to FIGS. 4 to 13. Through the first and the second embodiment of the present invention, like reference numerals apply to similar parts. Consequently, such similar parts of the second embodiment of the present invention will not be described to avoid redundancy in in description.

Figure 4:
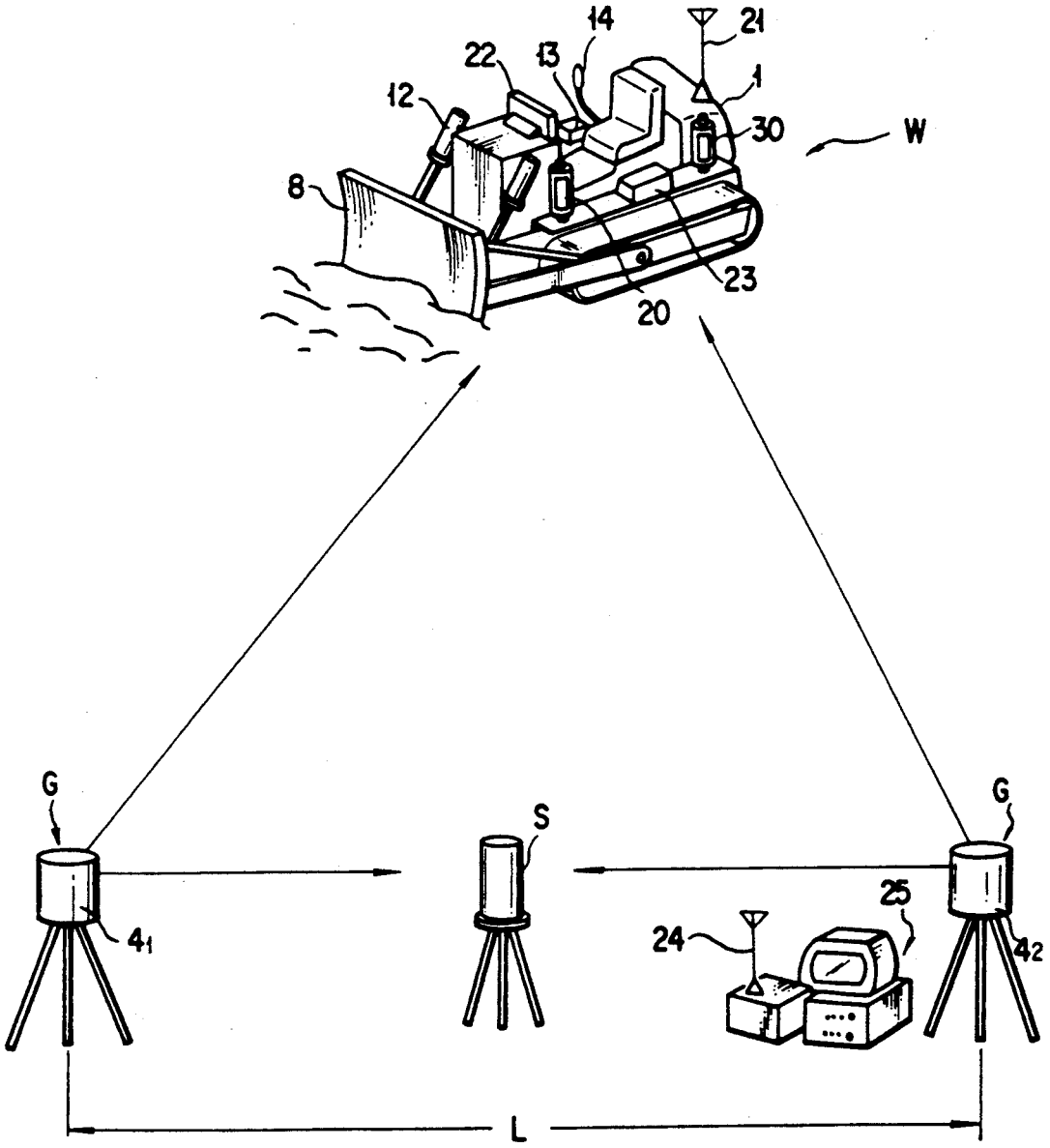
FIG. 4 is an overall schematic perspective view of a second embodiment of the blade control system of the present invention, illustrating the entire construction of the embodiment.

In FIG. 4 illustrates an overall schematic perspective view of the second embodiment of the blade control system for the bulldozer of the present invention, the reference character G denotes a ground station, and the reference character W denotes the bulldozer.

First of all, a pair of photo projectors $4_1$ and $4_2$, which are spaced apart from each other by a distance L, are installed on the ground station G. In a substantially central position between the pair of the photo projectors $4_1$, $4_2$ is installed a reference-light receiver S for detecting a reference direction.

On the other hand, a pair of photo receivers 20 and 30 are mounted on a front and a rear portion of the tractor body portion 1 of the bulldozer, respectively. In addition to the photo receivers 20, 30, further mounted on the tractor body portion 1 of the bulldozer are: a wireless unit 3; the blade controller 13; on-vehicle monitor 22; and position-measuring controller 23.

Incidentally, since the other parts of the bulldozer do not relate to the present invention, they are not described herein. In operation, the blade 8 of the bulldozer is operated by the cylinder 12 in which the cylinder-stroke sensor (not shown) is incorporated. The cylinder 12 is operated through the hydraulic valve actuator 14 which is controlled by the instruction signal issued from the blade controller 13.

In the ground station G, there are installed, a wireless unit 24 for receiving signals issued to/from the bulldozer, and a ground monitor 25.

With reference to the above construction of the second embodiment of the blade control system of the present invention, a process for determining a work position of the bulldozer, which position is represented by positions of the pair of the photo receivers 20, 30 of the bulldozer relative to the pair of the photo projectors $4_1$, $4_2$ installed in the area to be leveled by the bulldozer, will be described.

Figure 5:
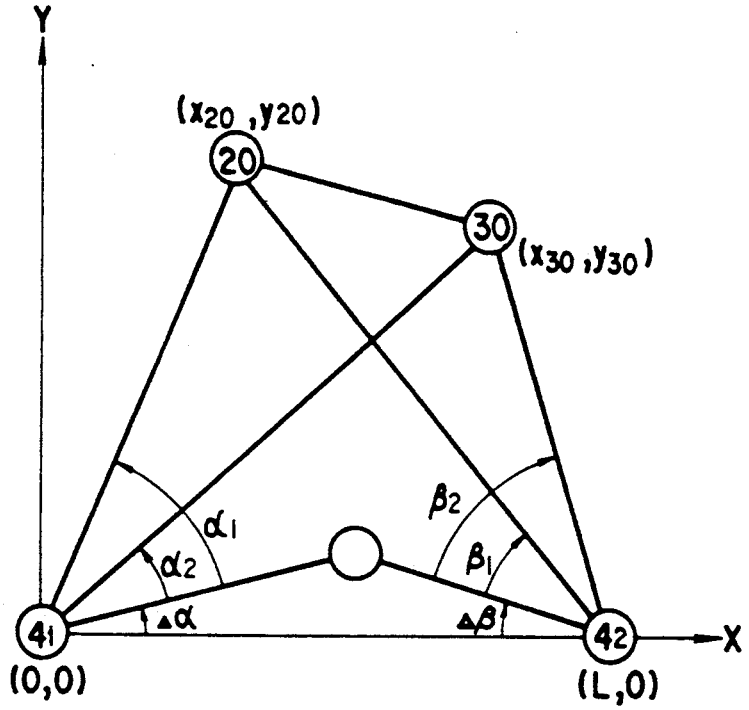
FIG. 5 is an x-y coordinate system for showing, in plan view, a position of each of the light projecting means and the light receiving means employed in the second embodiment of the present invention.

In order to facilitate description of the present invention, as shown in FIG. 5, an x-y coordinate system is employed, in which coordinate system a position of the photo projector $4_1$ constitutes an origin of the coordinate system, so that a position or point of each of the other photo projector $4_2$, reference-light receiver S, and the photo receivers 20, 30 mounted on the tractor body portion 1 of the bulldozer is represented by the abscissa and the ordinate of the point. FIG. 5 shows the relationship between the positions of the photo projectors and the photo receivers.

In operation, the photo projectors $4_1$ and $4_2$ are rotatably driven so that the laser beam lights issued therefrom are swung from the reference-light receiver S to the photo receivers 20 and 30, respectively. Namely, the photo projector $4_1$ is rotatably driven in a counterclockwise direction, while the other photo projector $4_2$ is rotatably driven in a clockwise direction, as shown in FIG. 5.

In the above operation, an optical reference plane formed by the laser beam light issued from the photo projector $4_1$ is so formed as to coincide in height and tilting angle with that formed by the laser beam light issued from the other photo projector $4_2$. Under such circumstances, the laser beam light issued from each of the photo projectors $4_1$, $4_2$ is received by the reference-light receiver S each time each of the photo projectors $4_1$, $4_2$ completes one turn in a predetermined period of time Ta, Tb. Namely, in the period of time Ta, the photo projector $4_1$ completes one turn, while the other photo projector $4_2$ completes one turn in the period of time Tb. The periods of time Ta, Tb are measured by the ground monitor 25 (shown in FIG. 4) which transmits data of the thus measured periods of time Ta, Tb to the bulldozer W through the ground station G by the use of the wireless unit 21, 24 (shown in FIG. 4), so that the data of the thus measured periods of time Ta, Tb is stored in the position-measuring controller 23 (shown in FIG. 4).

In the above operation, further stored in the position-measuring controller 23 is data as to the distance L between the photo projectors $4_1$ and $4_2$, an angle of $\Delta\alpha$ ($\Delta$alpha) formed between the x-axis and a straight line connecting the origin or photo projector $4_1$ with the reference-light receiver S, and an angle $\Delta\beta$ ($\Delta$beta) formed between the x-axis and a straight line connecting the other photo projector $4_2$ with the reference-light receiver S.

Further, in the operation, at a starting time when the reference-light receiver S receives each of the laser beam lights issued from the photo projectors $4_1$, $4_2$, the position-measuring controller 23 starts to measure each of the periods of time $ta_1$, $tb_1$, $ta_2$, $tb_2$ until each of the laser beam lights is received by each of the photo receivers 20, 30. The periods of time $ta_1$, $tb_1$ are measured until each of the laser beam lights is received by the photo receiver 20, and the periods of time $ta_2$, $tb_2$ are measured until each of the laser beam lights is received by the photo receiver 30. The above starting time is determined when the ground monitor 25 (shown in FIG. 4) detects a detection time at which the reference-light receiver S receives each of the laser beam lights, data of which detection time is immediately transmitted to the bulldozer W through the wireless unit 24 to permit the position-measuring controller 23 to start measuring each of the periods of time $ta_1$, $tb_1$, $ta_2$, $tb_2$ which are stored in the controller 23.

Then, the position-measuring controller 23 calculates the following equations 1 to 4 based on the above data as to: the periods of time (Ta, Tb, $ta_1$, $tb_1$, $ta_2$, $tb_2$), the angles ($\Delta\alpha$, $\Delta\beta$); and the distance L; so as to determine angles $\alpha_1$, $\alpha_2$, $\beta_1$, $\beta_2$ of the photo receivers 20, 30 (shown in FIG. 5) together with positions ($X_{20}$, $Y_{20}$) and ($X_{30}$, $Y_{30}$):

$$\alpha_1 = 2\pi . ta_1 / Ta \qquad 1$$

$$\beta_1 = 2\pi . tb_2 / Tb$$

$$\alpha_2 = 2\pi . ta_2 / Ta \qquad 2$$

$$\beta_2 = 2\pi . tb1 / Tb$$

$$X_{20} = L.((\cos(\alpha_1 + \Delta\alpha) \sin(\beta_1 + \Delta\beta))/((\sin(\alpha_2 + \beta_1 + \Delta\alpha + \Delta\beta))$$

$$Y_{20} = L.((\sin(\alpha_1 + \Delta\alpha)\sin(\beta_1 + \Delta\beta))/((\sin(\alpha_1 + \beta_1 + \Delta\alpha + \Delta\beta)) \qquad 3$$

$$X_{30} = L.((\cos(\alpha_2 + \Delta\alpha)\sin(\beta_2 + \Delta\beta))/((\sin(\alpha_2 + \beta_2 + \Delta\alpha + \Delta\beta))$$

$$Y_{30} = L.((\sin(\alpha_2 + \Delta\alpha)\sin(\beta_2 + \Delta\beta))/((\sin(\alpha_2 + \beta_2 + \Delta\alpha + \Delta\beta)) \qquad 4$$

Now, a process for determining the progress of the ground leveling work performed by the bulldozer with the blade control system of the present invention will be described.

Figure 6:
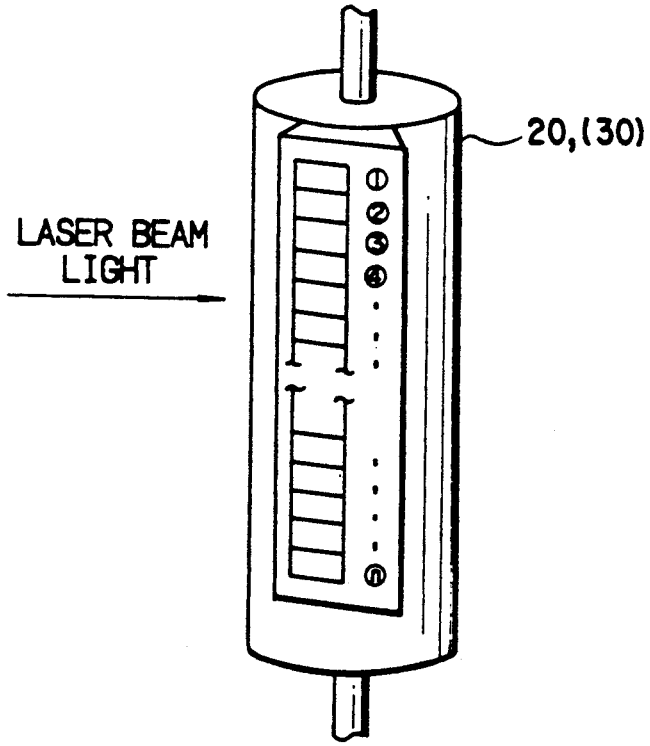
FIG. 6 is a schematic perspective view of the light receiving means employed in the second embodiment of the present invention shown in FIG. 4, illustrating the construction of the light receiving means.

As shown in FIG. 6, in each of the photo receivers 20, 30, a plurality of photo receiver elements 1, 2, 3, . .

. n are arranged in a vertical row. In operation, when the laser beam light (denoted by the arrow shown in FIG. 6) is issued to the photo receivers 20, 30, one of the photo receiver elements of each of the receivers 20, 30 receives the laser beam light so as to determine a height or vertical position of the laser beam light, at which position the laser beam light is detected by each of the photo receivers 20, 30.

Figure 7A:
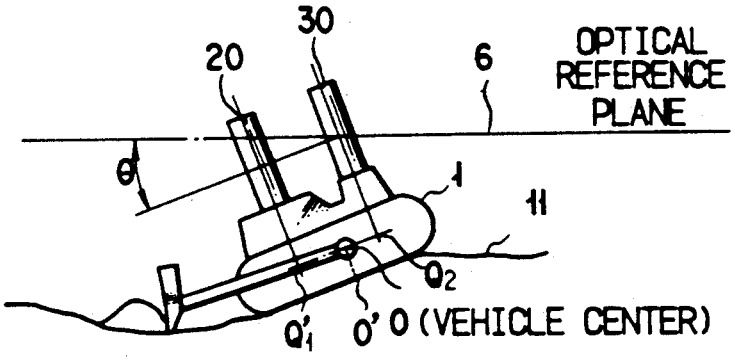
FIG. 7A is a side view of the bulldozer, employed in calculation of the progress of the work performed with the use of the second embodiment of the present invention shown in FIG. 4.

Consequently, as shown in FIG. 7A, in the ground leveling work, in case that the blade 8 of the tractor body portion 1 of the bulldozer pushes earth on the tractor-bearing ground 11 in a condition in which the bulldozer is inclined or pitched, since each of the photo receivers 20, 30 has the above construction, the horizontal optical reference plane 6 is detected by them 20, 30 as if it were an oblique plane inclined at an angle $\theta$ relative to the tractor reference plane 7 shown in FIG. 1.

In FIG. 7A, the reference numeral 0 denotes a vehicle center of the tractor body portion 1 of the bulldozer; $Q_1$ a front point in a vehicle plane passing through the vehicle center 0, which plane is parallel to the tractor reference plane 7 shown in FIG. 1, the front photo receiver 20 being mounted on the tractor body portion 1 of the bulldozer at the front point $Q_1$; $Q_2$ a rear point in the vehicle plane, the rear photo receiver 30 being mounted on the tractor body portion 1 of the bulldozer at the rear point $Q_2$; and 0' a ground intersection point at which the tractor-bearing ground 11 intersects a line passing through the vehicle center 0, the line being perpendicular to the tractor-bearing ground 11.

Figure 7B:
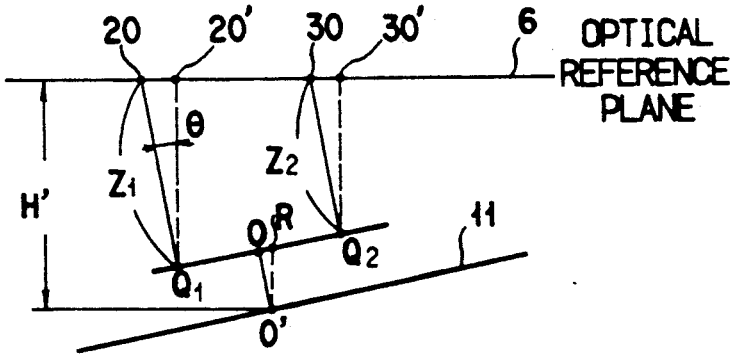
FIG. 7B is a geometrical side view of essential parts of the bulldozer, employed in calculation of the progress of the work performed with the use of the second embodiment of the present invention shown in FIG. 4.

In addition, FIG. 7A may be converted into a geometrically simplified diagram such as FIG. 7B in which: the reference character $Z_1$ denotes a distance between the front point $Q_1$ and the front photo receiver 20; $Z_2$ a distance between the rear point $Q_2$ and the rear photo receiver 30; and H' a minimum distance between the horizontal optical reference plane 6 and the ground intersection point 0'.

Consequently, as is clear from FIG. 7B, the minimum distance H' and the position of the vehicle center 0 in the coordinate system may be calculated according to the following equations 5 and 6, respectively. Incidentally, in FIG. 7B: the reference numeral 20' denotes a front intersection point at which the optical reference plane 6 intersects a line passing through the front point $Q_1$, the line being perpendicular to the optical reference plane 6; 30' a rear intersection point at which the optical reference plane 6 intersects a line passing through the rear point $Q_2$, the line being perpendicular to the optical reference plane 6; R a central intersection point at which a line segment $Q_1$–$Q_2$ passing through the points $Q_1$ and $Q_2$ intersects a line passing through the ground intersection point 0', the line being perpendicular to the optical reference plane 6.

In calculation of the minimum distance H', as shown in FIG. 7B: the distances $Z_1$ and $Z_2$ may be detected by the photo receivers 20 and 30, respectively; a line segment 0-$Q_1$ passing through the vehicle center 0 and the point $Q_1$ is known; a line segments 0-$Q_2$ passing through the vehicle center 0 and the point $Q_2$ is known; a line segment 0–0' passing through the vehicle center 0 and the ground intersection point 0' is known; and the angle $\theta$ is negligible. Consequently, as is clear from FIG. 7B: a line segment 20-$Q_1$ passing through the points 20 and $Q_1$ is substantially equal in length to a line segment 20'-$Q_1$ passing through the points 20' and $Q_1$, so that twice the line segment 20-$Q_1$ is substantially equal in length to twice the line segment 20'-$Q_1$; a line segment 30-$Q_2$ passing through the points 30 and $Q_2$ is substantially equal in length to a line segment 30'-$Q_2$ passing through the points 30' and $Q_2$, so that triple the line segment 30-$Q_2$ is substantially equal in length to triple the line segment 30'-$Q_2$; and a line segment 0–0' passing through the vehicle center 0 and the ground intersection point 0 is substantially equal in length to a line segment R-0' passing through the central intersection point R and the ground intersection point 0'. As a result, the minimum distance H' may be derived from the following equation 5:

$$H' = ((Z_1 + Z_2)/Z) + (\text{the length of the line segment } 0\text{–}0') \qquad 5$$

On the other hand, the position ($X_0$, $Y_0$) of the vehicle center 0 in the coordinate system may be derived from the following equation 6:

Namely, since the vehicle center 0 is a center of the line segment $Q_1$–$Q_2$, the x-coordinate $X_0$ and the y-coordinate $Y_0$ of the vehicle center 0 may be derived from the following equation 6:

$$X_0 = (X_{20} + X_{30})/2$$

$$Y_0 = (Y_{20} + Y_{30})/2 \qquad 6$$

According to the process described above, the position-measuring controller 23 of the blade control system for the bulldozer of the present invention may calculate: the position of the bulldozer relative to the photo projectors $4_1$ and $4_2$ in the coordinate system; and a necessary data in the ground leveling work relative to the optical reference plane 6. Based on the thus calculated data, a desired data (x, y, H') of the progress of the work in each section in the area to be leveled may be obtained.

Figures 8, 9:
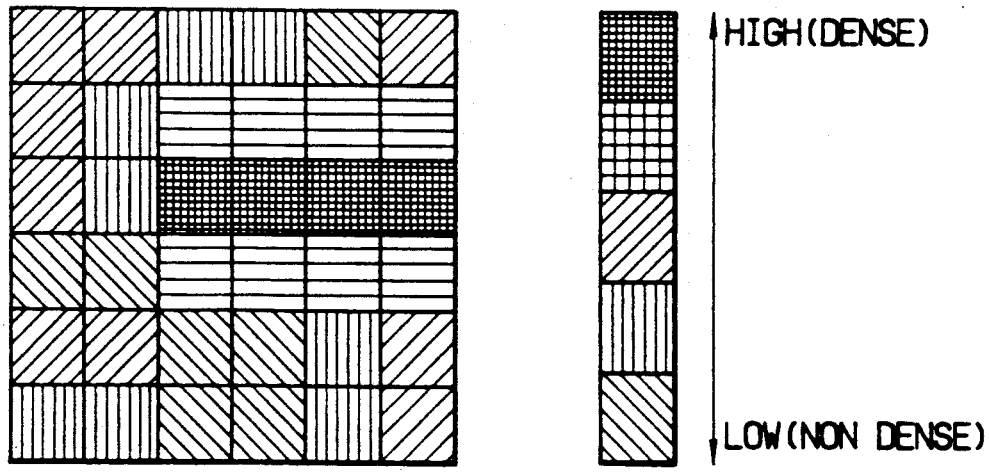
FIG. 8 is a diagram illustrating a method for storing necessary data of the progress of the work performed by the second embodiment of the present invention shown in FIG. 4.
FIG. 9 is a diagram illustrating a method for displaying the necessary data of the progress of the work performed by the second embodiment of the present invention shown in FIG. 4.

Now, based on the above data (x, y, H') of the progress of the work, the following control will be described. In case that the area to be leveled assumes a square shape, as shown in FIG. 8, the area is divided into a plurality of square sections in both of an x- and a y-direction, such as: x1, x2, x3, . . . , xn; and y1, y2, y3, . . . , yn, respectively. The desired data (xi, yi, hij) of the progress of the work in each square section is stored in memory means incorporated in the position-measuring controller 23 (or in a separate memory means) to form a two-dimensional data array, wherein: each of the suffix i, j may assume 1, 2, 3, . . . , n. As shown in FIG. 9, the thus formed two-dimensional data array may be converted into a variable-density pattern image display by the position-measuring controller 23. In the thus converted image display, a dense pattern represents a rapid progress of the work, while a nondense pattern represents a slow progress of the work.

Figure 11:
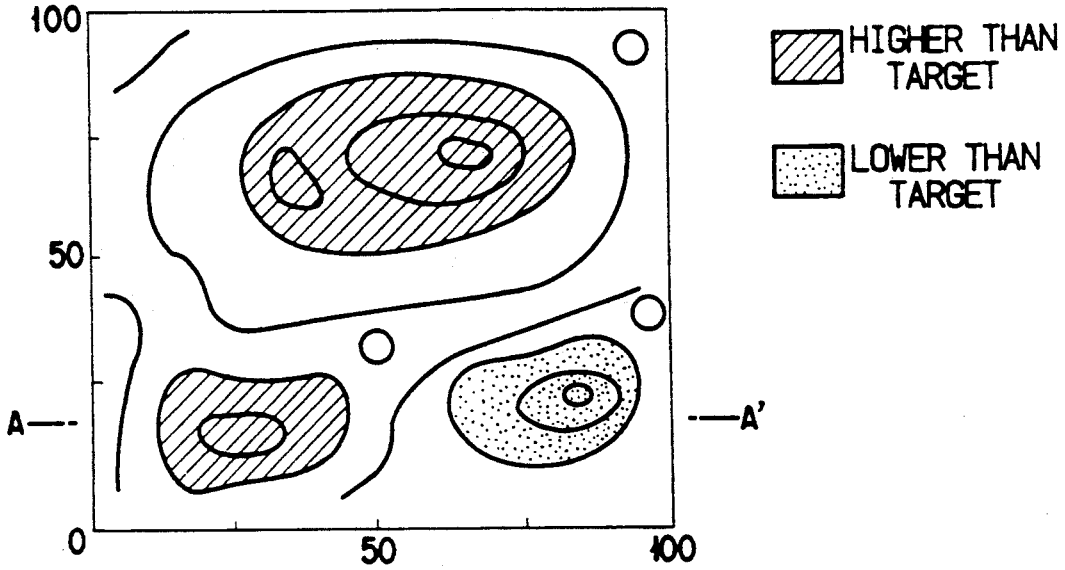
FIG. 11 is a contour map for illustrating the progress of the work accomplished by the second embodiment of the present invention shown in FIG. 4.
Figure 12:
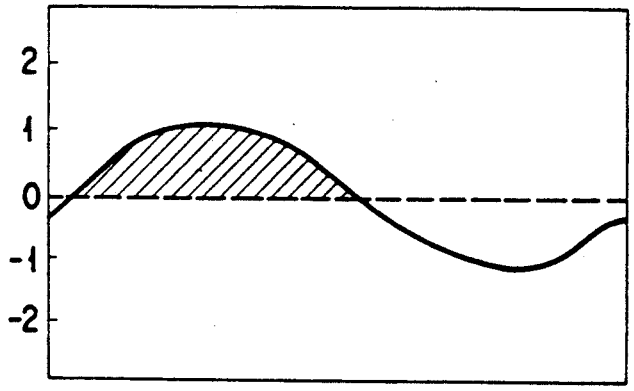
FIGS. 12 and 13 are cross-sectional views of the contour map, taken along the line A–A'.

Incidentally, as shown in FIGS. 11 and 12, the two-dimensional data array may be converted into a contour map image display or a cross-sectional image display taken along any desired direction.

In case of the contour map image display shown in FIG. 11, the operator of the bulldozer monitors the display during the ground leveling work and operates the bulldozer so that: a concave portion of the ground relative to the target ground level, which portion is represented by a dotted area, is filled with earth up to the target ground level; and in convex portions of the ground relative to the target ground level (which portions are represented by hatched areas), the bulldozer removes earth until it reaches the target ground level.

Figure 13:
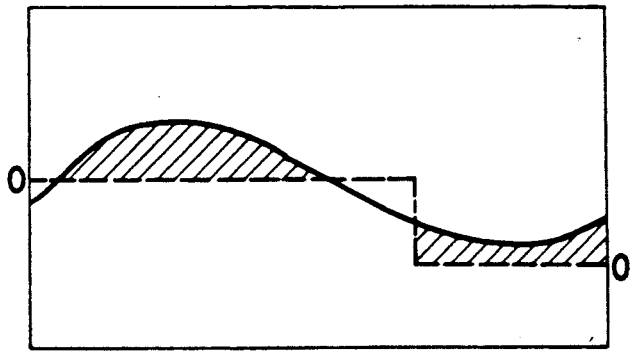

On the other hand, as is clear from the cross-sectional view shown in FIG. 12 of the area to be leveled, it is possible to easily calculate through integration the amount of earth to be filled in the concave portion of the ground or to be removed from the convex portion of the ground. Incidentally, as shown in FIG. 13, in the ground leveling work, the amount of earth to be filled in and removed from the portion of the area may be adjustable in an appropriate manner.

Any of the above image displays may be monitored through the on-vehicle monitor 22. In addition, the data of the progress of the work may be transmitted to the ground station G through the wireless units 21, 24 to enable the ground monitor 25 to store and display the data.

The block diagram of the blade control system of the present invention described above is shown in FIG. 10.

Figure 10:
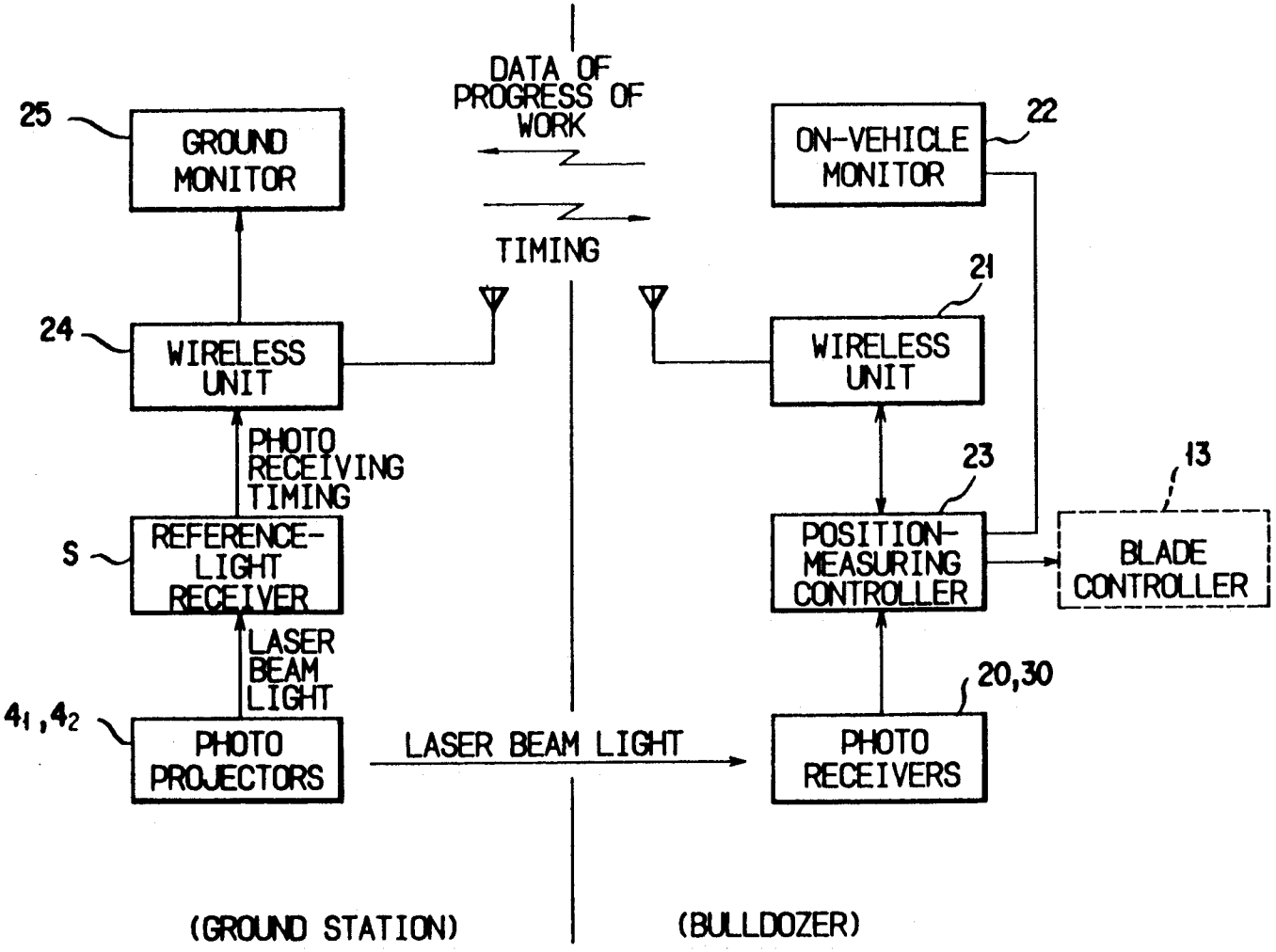
FIG. 10 is an overall schematic diagram of the second embodiment of the blade control system of the present invention shown in FIG. 4.

Transmission of the data between the ground station G and the bulldozer shown in the block diagram of FIG. 10 is already described above in detail, and, therefore it is not described again. In the ground leveling work, although the data of the progress of the work is obtained in the position-measuring controller 23 as described above, in case that it is necessary to move earth additionally, the position-measuring controller 23 issues an earth-moving instruction signal to the blade controller 13. Upon receipt of the instruction signal, the blade controller 13 to make the hydraulic valve actuator 14 (shown in FIG. 4) actuate the hydraulic cylinder 12, so that the cylinder 12 moves the blade 8 so as to perform the desired ground leveling work.

We claim:

1. In a blade control system for a bulldozer for performing ground leveling work or grading work by automatically controlling a vertical position of a blade of a bulldozer during the work, of the type comprising a light projecting means for forming over a predetermined ground area a horizontal optical reference plane or an oblique optical reference plane inclined at an arbitrary angle, said light projecting means being installed at a location remote from said bulldozer; a light receiving means mounted on a tractor body portion of said bulldozer for detecting said optical reference plane formed by said light projecting means to issue a level signal; and a control means which receives said level signal to control a hydraulic valve actuator of said bulldozer based on said level signal, which hydraulic valve actuator moves said blade of said bulldozer, the improvement wherein:

said light receiving means comprises at least a pair of photo receivers which are respectively arranged along a longitudinal axis of said tractor body portion of said bulldozer and spaced apart from each other to form a tractor reference plane therebetween; and a blade controller which controls said hydraulic valve actuator based on a first output signal issued from one of said photo receivers at a first location on said reference plane, and a second output signal issued from the other of said photo receivers at a second location on said reference plane, said second location being longitudinally spaced from said first location, said controller relating said tractor reference plane and said optical reference plane.

2. The blade control system for the bulldozer as set forth in claim 1, wherein:

said light projecting means comprises a pair of photo projectors, each of said photo receivers of said light receiving means has the facility for detecting a three-dimensional position of said tractor body portion of said bulldozer; and said blade controller of said light receiving means controls said hydraulic valve actuator based on an output signal issued from a position measuring controller, which position measuring controller receives said output signal issued from each of said photo receivers to obtain progress data of said work.

3. The blade control system for the bulldozer as set forth in claim 2, further including a wireless unit and an on-vehicle monitor mounted on said bulldozer in addition to said photo receivers; and a ground wireless unit and a ground monitor installed on the ground.

4. The blade control system for the bulldozer as set forth in claim 1, wherein:

said blade control system further comprises a cylinder stroke sensor which detects a stroke of said hydraulic valve actuator to issue a stroke signal of the thus detected stroke, said stroke signal being fed back to said blade control system.

5. A blade control system for a bulldozer, comprising:

a bulldozer having a tractor body portion defining a longitudinal axis, a blade of said bulldozer for performing ground leveling work or grading work, means for controlling a vertical position of the blade during the work, and means responsive to said controlling means for moving said blade in a vertical direction;

light projecting means for forming over a predetermined ground area a horizontal optical reference plane or an oblique optical reference plane inclined at an arbitrary angle, said light projecting means being located at a position remote from said bulldozer and in light communication therewith;

a light receiving means mounted on said tractor body portion of said bulldozer for detecting said optical reference plane formed by said light projecting means to issue a level signal to said controlling means, whereby said controlling means controls said vertical position of said blade in response thereto, said light receiving means comprising at least a pair of photo receivers arranged along said longitudinal axis of said tractor body portion of said bulldozer and spaced apart from each other and forming a tractor body reference plane, said controlling means being responsive in part to a distance between the tractor body reference plane and a tractor bearing ground surface to calculate vertical distance to be moved by said blade, said controlling means being responsive in part to a first output signal issued from one of said photo receivers at a first location on said reference plane, and a second output signal issued from the other of said photo receivers at a second location on said reference plane, said second location being longitudinally spaced from said first location, said controller.

* * * * *